US005714049A

United States Patent [19]

Shastry et al.

[11] Patent Number: 5,714,049

[45] Date of Patent: Feb. 3, 1998

[54] PROCESS FOR IMPROVING THE FORMABILITY AND WELDABILITY PROPERTIES OF ZINC COATED SHEET STEEL

[75] Inventors: C. Ramadeva Shastry, Bethlehem, Pa.; Stavros G. Fountoulakis, Pattenburg, N.J.; Elmer J. Wendell, Bethlehem, Pa.

[73] Assignee: Bethlehem Steel Corporation

[21] Appl. No.: 767,378

[22] Filed: Dec. 16, 1996

Related U.S. Application Data

[62] Division of Ser. No. 447,656, May 23, 1995, abandoned.

[51] Int. Cl.[6] ..... B32B 15/00

[52] U.S. Cl. ..... 205/50; 428/629; 428/659; 427/406; 427/419.2

[58] Field of Search ..... 205/50, 94; 428/629, 428/632, 659; 427/406, 419.2

[56] References Cited

U.S. PATENT DOCUMENTS

| | | | |
|---|---|---|---|
| 3,415,692 | 12/1968 | Armentano | 148/6.14 |
| 3,843,494 | 10/1974 | Brown | 204/34 |
| 4,707,415 | 11/1987 | Ikedo et al. | 428/621 |
| 4,957,594 | 9/1990 | Yamazaki et al. | 204/27 |
| 5,203,986 | 4/1993 | Shiohana et al. | 205/305 |

FOREIGN PATENT DOCUMENTS

| | | |
|---|---|---|
| 446701 | 9/1991 | European Pat. Off. . |
| 456834 | 11/1991 | European Pat. Off. . |
| 1-149996 | 6/1989 | Japan . |
| 1149996 | 6/1989 | Japan . |
| 4-021751 | 1/1992 | Japan . |
| 421751 | 1/1992 | Japan . |

*Primary Examiner*—Kathryn L. Gorgos
*Assistant Examiner*—Kishor Mayekar
*Attorney, Agent, or Firm*—Harold I. Masteller, Jr.; Joseph W. Berenato, III

[57] ABSTRACT

A post plating or post coating method for improving formability and weldability properties in sheet steel product having a protective zinc or zinc alloy layer formed on at least one surface thereof. The steps of the method comprise immersing the sheet steel product into a bath containing at least zinc to apply the protective layer, removing the sheet steel product from the bath, the sheet steel product having a protective zinc or zinc alloy layer formed on at least one surface thereof, and applying an alkaline solution to the protective layer to form a zinc oxide layer thereon, the alkaline solution being applied at a location outside the bath.

7 Claims, 2 Drawing Sheets

1A
10
9
A
5
6
7
8
6a
7a
8a
7b
2
3
4

PROCESS FOR IMPROVING THE FORMABILITY AND WELDABILITY PROPERTIES OF ZINC COATED SHEET STEEL

This is a division of application Ser. No. 08/447,656, filed May 23, 1995, now abandoned.

BACKGROUND OF THE INVENTION

This invention is related to a process for improving the formability, weldability and surface appearance of zinc coated and zinc alloy coated sheet steel, and in particular, this invention is directed to improving the formability and weldability of electrogalvanized sheet steel. Zinc coated sheet steel is used for a variety of different automotive components. For example, hot-dip galvanized sheet steel is used in portions of the automobile where surface appearance is not important such as the underbody, door beams and trunk interiors. On the other hand, because of their high surface quality appearance, galvanic electrogalvanized and zinc alloy coated sheet steels tend to be used throughout the exterior portions of automobiles such as doors, hoods and deck lids, where a high gloss painted finish is important.

Zinc coated sheet steel products enjoy a major share of the automotive market because they have excellent resistance to corrosion and mechanical damage. However the protective zinc coatings are viewed, in some instances, as being unfavorable with respect to formability and weldability when compared to zinc alloy coatings.

Zinc coatings applied to sheet products tend to deform and gall during press forming operations. When the forming punch makes contact with the coated surface of the product, the coated surface galls and produces a buildup of zinc flakes within the die. The zinc flakes in turn cause defects in the surface appearance of the finished formed sheet product and, in order to overcome the problem, continuous downtime is required for maintenance and cleaning of the press forming dies.

Weldability of zinc coated sheet is also a problem. It is generally inferior to the weldability properties of zinc alloy coated or uncoated sheet steel. This is because the zinc coating melts during resistance welding and alloys with the copper in the electrode tip. The chemical reaction causes poor quality weld joints and reduces weld tip life.

The forming and welding difficulties encountered with zinc coated sheet steel is well known within the steelmaking industry. In the past, there have been various attempts to improve both the formability and weldability. One of the more significant solutions to the problem is to provide a layer on the outer surface of the protective zinc or zinc alloy coating which will improve the forming and welding properties. U.S. Pat. No. 3,843,494 granted to Brown on Oct. 22, 1974 shows one such improvement. Brown discloses a process comprising the steps of applying on a ferrous metal substrate separate layers of metallic zinc and metallic iron, the outermost layer being a metallic iron layer which promotes the ease with which a plurality of said zinc coated ferrous substrates may be welded by resistance spot welding.

A further improvement in the art, directed more to surface appearance than weldability, is shown in U.S. Pat. No. 4,707,415. This patent teaches dipping zinc alloy coated sheet steel into an acidic oxidizing solution to electrochemically form a passive-state layer on the surface of the zinc alloy coating. The passive-state layer comprises at least one of oxides, hydroxides, and sulfides of zinc and nickel.

U.S. Pat. Nos. 4,957,594 and 5,203,986 teach forming a zinc oxide layer on the surface of zinc and zinc alloy steels to improve weldability. The 594 patent teaches adding an oxidizer to an acidic plating bath to form a zinc oxide or zinc hydroxide layer during the electroplating operation. Similarly, the 986 patent also teaches forming an oxide layer by using an oxidizer in an acidic plating bath, but with the addition of introducing a buffering agent into the bath to control the pH level.

Introducing various oxidizers and buffers into plating and coating baths to improve formability and weldability properties is not desirable from an operational viewpoint. Such additives tend to create complex, and sometimes unexpected, reactions which can lead to both environmental and product quality problems. For example, the addition of $H_2O_2$ in a zinc sulphate plating bath can adversely impact on the morphology of the zinc plating and produce a coating unsuitable for finished automotive surfaces. Such additives also tend to reduce the efficiency of the coating line. Additionally, when nitrate or nitrite oxidizers are added to a plating bath, they may precipitate into complex compounds which are environmentally unsound and must be treated for proper disposal.

It has been discovered that the above problems can be avoided by using a post plating, or post coating, alkaline solution treatment to form a zinc oxide layer on the outer surface of a zinc or zinc alloy layer formed on a sheet steel product. This can be accomplished by applying an alkaline solution comprising an oxidizer to the surface of the zinc or zinc alloy layer, at a location separate from the plating or coating bath. The alkaline solution forms a suitable oxide layer on the surface of the zinc or zinc alloy layer, improves the formability and weldability, and avoids both environmental and product quality problems.

SUMMARY OF THE INVENTION

It is therefore an object of this invention to improve the formability and weldability properties of a zinc or zinc alloy plated or coated steel sheet product.

It is a further object of this invention to provide a zinc or zinc alloy plated or coated steel sheet product having excellent surface quality and appearance while improving the formability and weldability properties of the sheet steel product.

It is still a further object of this invention to form an oxide coating on the surface of a zinc or zinc alloy layer formed on a sheet steel product to improve the formability and weldability properties of the sheet steel product.

It is still a further object of this invention to form an oxide coating on the surface of a zinc or zinc alloy layer formed on a sheet steel product to improve the formability and weldability properties of the sheet steel product without introducing additives into a plating or coating bath.

And finally, it is still a further object of this invention to reduce environmental impact by applying an alkaline solution comprising an oxidizer to the surface of a zinc or zinc alloy layer formed on a sheet steel product to form an oxide layer on the surface thereof to improve the formability and weldability properties of the sheet steel product, the alkaline solution being applied at a location separate from a plating or coating bath.

Still other objects and advantages of this invention will be obvious and apparent from the specification.

We have discovered that the foregoing objects can be attained by using a post plating or post coating method for improving the formability and weldability properties in sheet steel product having a protective zinc or zinc alloy layer foraged on at least one surface thereof. The steps of the method comprise immersing the sheet steel product into a bath containing at least zinc to apply the protective layer, removing the sheet steel product from the bath, the sheet steel product having a protective zinc or zinc alloy layer formed on at least one surface thereof, and applying an alkaline solution comprising an oxidizer to the protective layer to form a zinc oxide layer on at least one surface thereof, the alkaline solution being applied at a location separate from the bath.

DESCRIPTION OF A PREFERRED EMBODIMENT

Figures 1, 2, 3:
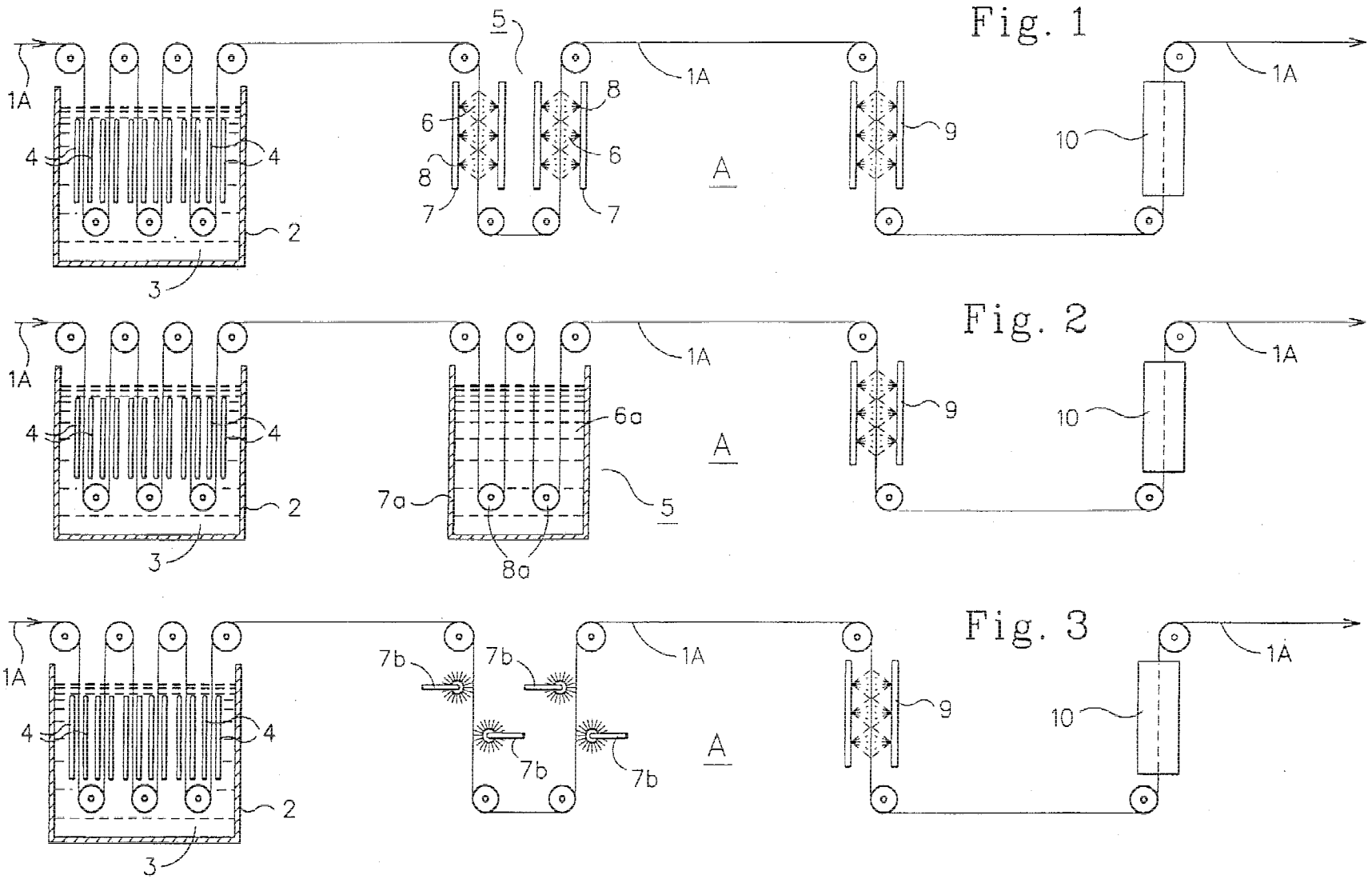
FIG. 1 shows the preferred embodiment of the present invention in use on an electrogalvanized plating line.
FIG. 2 is an alternate embodiment of the present invention similar to FIG. 1.
FIG. 3 is a still further alternate embodiment of the present invention similar to FIG. 1.

The preferred method for improving the formability and weldability properties of zinc or zinc alloy plated, or coated, sheet steel products comprises the post plating step of applying an alkaline solution comprising an oxidizer to the protective plating or coating on the steel substrate to form a zinc oxide layer on at least one surface thereof, the alkaline solution being applied at a location separate from the plating or coating bath. Referring to FIG. 1 of the drawings, a continuous sheet steel strip 1A is shown being electrochemically plated in the last plating cell 2 of an electrogalvanizing line "A". In the preferred embodiment, the sheet steel is shown being immersed in a zinc plating bath 3 and passing between spaced pairs of anodes 4 to plate two sides of the continuous sheet steel strip 1A. It should be understood, however, that single anodes could be used to plate only one side of the steel strip without departing from the scope of this invention.

After completion of the final plating step, as illustrated by plating cell 2, the zinc plated sheet steel strip continues toward an alkaline treatment station 5 where an oxidizer is applied to the protective zinc layer to produce a zinc oxide layer on the surface thereof. The zinc oxide layer is conducive to improving formability and weldability of such zinc plated sheet steel products. In the preferred embodiment, strip 1A is shown being sprayed with a buffered alkaline solution 6 containing an oxidizer. The alkaline treatment station 5 includes spray headers 7 having a plurality of spray nozzles 8 for applying the alkaline solution 6 to the surface of strip 1A.

The oxidizer in the alkaline solution reacts with the zinc plated layer on the steel strip to form an outer zinc oxide layer and the sheet steel strip 1A advances toward a wash station 9 where a warm water rinse of about 120° F. is applied to the coated sheet product for up to about 20 seconds. The strip is then advanced to a drying station 10 where an air, or resistance, or other suitable means dryer is used to dry the sheet steel product, after which the sheet continues toward further processing such as oiling, shearing to length and wrapping or coiling for shipping.

Referring to FIG. 2 of the drawings, a continuous sheet steel strip 1A is shown being electrochemically plated in the last plating cell 2 of an electrogalvanizing line "A" similar to the line shown in FIG. 1. After completion of the final plating step, the zinc plated sheet steel strip continues toward an alkaline treatment station 5 where an oxidizer is applied to the protective zinc layer to produce a zinc oxide layer on the surface thereof. In this alternate embodiment, strip 1A is shown being immersed in a buffered alkaline solution 6*a* containing an oxidizer. The alkaline treatment station 5 includes an immersion tank 7*a* having at least one sinker roll 8*a* for guiding strip 1A into the alkaline solution.

Referring to FIG. 3 of the drawings, a continuous sheet steel strip 1A is shown being electrochemically plated in the last plating cell 2 of an electrogalvanizing line "A" also similar to the line shown in FIG. 1. After completion of the final plating step, the zinc plated sheet steel strip continues toward an alkaline treatment station 5 where an oxidizer is applied to the protective zinc layer to produce a zinc oxide layer on the surface thereof. In this alternate embodiment, the alkaline treatment station 5 includes roll coating apparatus 7*b* for applying the alkaline solution to one or more surfaces of strip 1A to form the zinc oxide layer.

It has been discovered that the preferred alkaline solution 6 contained in immersion tank 7 of treatment station 5 should be an oxidizer in a buffered alkaline solution having a pH range of about 7–11. Tests have also shown that in order to form a suitable zinc oxide layer of $\geqq 0.15$ g/m$^2$, the alkaline solution should be applied to the protective zinc layer for a period of from 1–17 seconds at a temperature range of about between 20°–50° C. The preferred treatment method and alkaline solution is based upon the following research.

Laboratory test specimens were prepared by first cleaning the specimens in an alkaline solution and then activated by immersing in an acid pickling bath and then electroplating the specimens under plating conditions shown in Table A. The specimens were then sprayed with various alkaline solutions as shown in Table B followed by a warm water rinse at a temperature of about 49° C. for 20 seconds, and then hot air dried. The oxidized specimens were finally tested for formability and weldability as well as inspected for surface quality and appearance.

From the group of alkaline solutions shown in Table B, it was discovered that the specimens prepared using a buffered alkaline solution comprising 30 g/l $H_2O_2$ exhibited the most favorable results. It was also discovered that $H_2O_2$ can be added to the alkaline solution at a rate of from 10 g/l to 100 g/l of $H_2O_2$, with 30 g/l to 60 g/l of $H_2O_2$ being a preferred range, and with 30 g/l of $H_2O_2$ being the best formula for the alkaline solution.

Using this knowledge, further test specimens were prepared using both buffered and non-buffered alkaline solutions comprising 30 g/l $H_2O_2$, and these specimens were compared with test specimens prepared using other oxidation processes well known in the art. For example, the oxide layer for samples 3, 4 and 5 shown in Table C was formed using an electrochemical process using platinized niobium insoluble anodes. All the specimens were tested for both formability and weldability. The test results are shown in Table C.

As a result of this research work, it was discovered that the preferred post plating or post coating alkaline solution for forming a zinc oxide layer comprises $NaOH+NaHCO_3+$ 30 g/l $H_2O_2$, a pH range of about 7.8–8.4, at a temperature range of about 20°–50° C.

Figure 4:
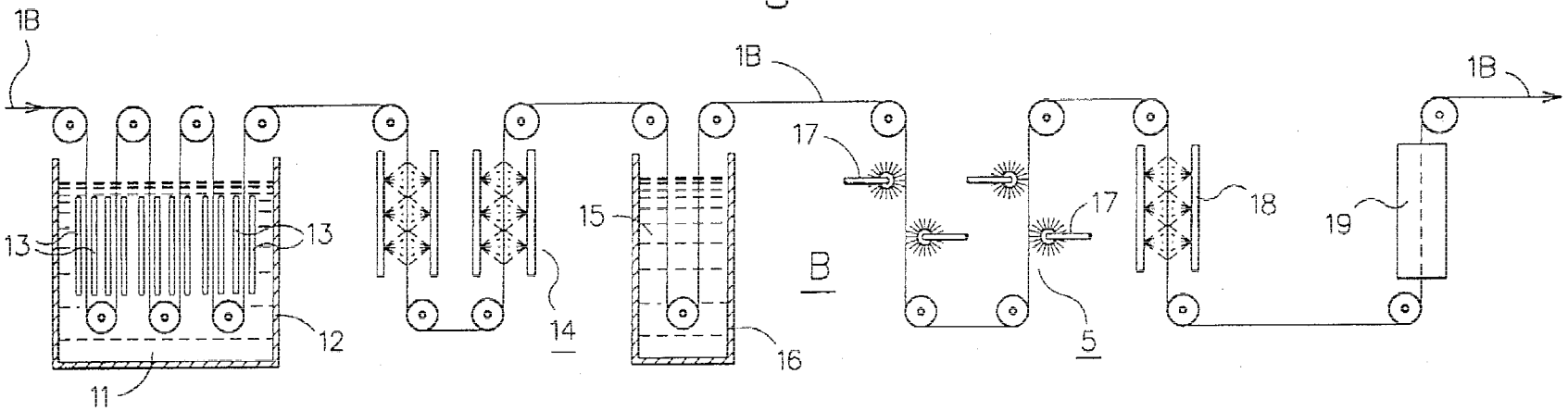
FIG. 4 shows the present invention in use on a plating line having a rinse immediately after the plating bath.

Referring to FIG. 4 of the drawings, an alternate embodiment of the post plating or post coating alkaline treatment invention is shown in use on an electroplating line "B" having a rinse station immediately following the last plating bath 12. Electroplating line "B" comprises a continuous sheet steel strip 1B being electrochemically treated in a plating bath 11 containing at least zinc ions in a plating cell 12 to form a protective coating of either zinc or zinc alloy on at least one surface of the sheet steel strip. The plating cell includes spaced pairs of anodes 13, and the sheet steel strip acts as a cathode in the acidic bath 11 containing the ions. The plated sheet steel strip is removed from the plating cell and advanced to an optional rinse step shown as station 14.

TABLE A

| Bath Type: | Sulfate |
|---|---|
| $Zn^{++}$ | 100 g/l |
| pH | 1.5–2.8 |
| Temperature | 49–60° C. |
| Coating Weight | 60 g/m$^2$ |
| Current Density | 60 A/dm$^2$ |

TABLE B

| | Post Treatment | | Avg. $Zn^{++}$ Wt. in Surface |
|---|---|---|---|
| No. | Chemical Solution | pH | Film g/m$^2$ |
| 1 | NaOH + 30 g/l $H_2O_2$ | 10.03 | 0.195 |
| 2 | NaOH + $NaHCO_3$ + 30 g/l $H_2O_2$ | 7.8 to 8.4 | 0.340 |
| 3 | NaOH | 10.03 | 0.071 |
| 4 | NaOH + 10 g/l $NaHCO_3$ | 8.26 | 0.149 |
| 5 | NaOH + 3 g/l $H_2O_2$ | 10.00 | 0.165 |
| 6 | NaOH + 3 g/l $H_2O_2$ + 5 g/l $NaHCO_3$ | 8.17 | 0.237 |
| 7 | NaOH + 3 g/l $H_2O_2$ + 10 g/l $NaHCO_3$ | 8.18 | 0.164 |
| 8 | NaOH + 10 g/l $NaNO_3$ | 10.04 | 0.103 |

Rinse station 14 may include any rinse means suitable for rinsing or cleaning the surface of the plated steel. In this instance we have shown using a spray rinse. The rinse may comprise either a water rinse, a dilute acid rinse such as a dilute $H_2SO_4$ solution, or an acidic rinse containing zinc ions.

After the rinse treatment at station 14, an electrolyte is applied to the protective zinc or zinc alloy layer at electrolyte station 16. In FIG. 2 the sheet steel strip is shown being dipped into an electrolyte solution 15 contained in an immersion tank. This step is done prior to the alkaline solution treatment to form a zinc electrolyte layer on the surface of the protective layer. The electrolyte may be applied to the plated surface of the sheet steel strip by any other suitable means known in the art such as spraying or roll coating or the like. However, it should be understood that the method of applying the electrolyte solution at station 16 is not an electrochemical assisted process. In addition, it should also be understood that if the acidic rinse of station 14 comprises a zinc ion concentration in a range of about 15–40 g/l, station 16 showing the application of an electrolyte solution to the sheet steel may be eliminated in the method taught in FIG. 4.

Following the step of applying an electrolyte solution to the strip, the strip is advanced to an alkaline solution treatment station 5 similar to any one of the treatment stations shown in FIGS. 1–3, or any like means known in the an suitable for applying the alkaline solution to the surface of the strip. In this instance, treatment station 5 is shown comprising roll coating apparatus 17 to apply the alkaline solution to the protective zinc or zinc alloy layer to form a zinc oxide layer on at least one surface thereof.

After the zinc oxide layer has been formed, the strip is advanced to wash station 18 where a warm water rinse of about 120° F. is applied to the coated sheet product for a period of about 20 seconds. The strip is then advanced to a drying station 19 where an air, or resistance, or other suitable means dryer is used to dry the rinsed sheet product, after which the sheet is advanced to move toward further processing such as oiling, shearing to length and wrapping or coiling for shipping.

Figure 5:
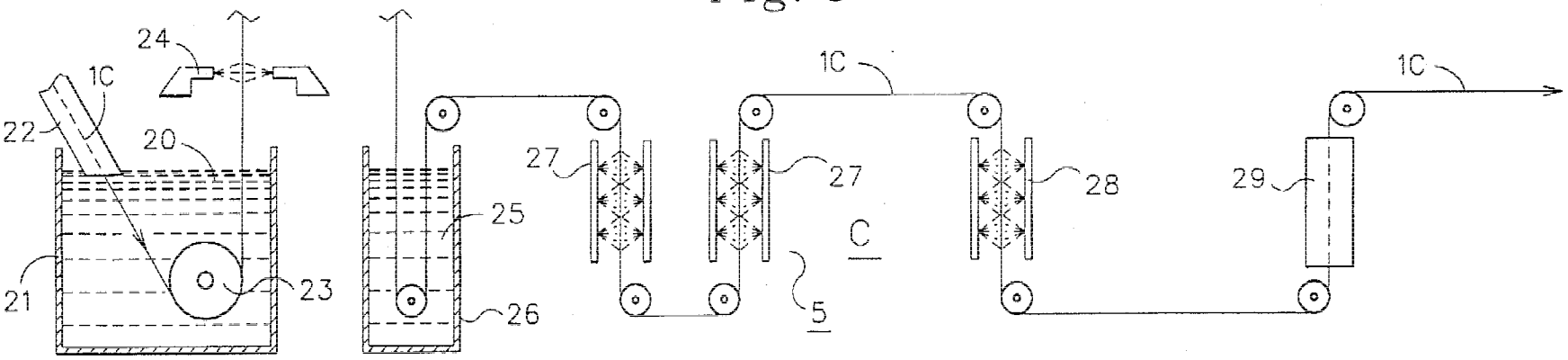
FIG. 5 shows the present invention in use on a hot-dip galvanized coating line.

FIG. 5 shows the present invention being used on a hot-dip galvanizing line. Hot-dip galvanizing line "C" comprises a continuous sheet steel strip 1C immersed into a hot-dip zinc or zinc alloy bath 20 contained in a tank 21. In some instances, the sheet steel strip may enter the hot-dip bath through a snorkel 22. The strip is immersed within the bath via a sinker roll 23 and exits the bath between gas

TABLE C

| | | | Property Tested | | | | |
|---|---|---|---|---|---|---|---|
| No. | Chemistry of Solution | Method of Application | Surface Film Wt. g/m$^2$ WSW | $Zn^{++}$ in Surface Film g/m$^2$ AA | $LDH_{min.}$ Inches | Coefficient of Friction μ | Tip Life No. of Welds |
| 1 | NaOH + 30 g/l $H_2O_2$ | Alkaline Spray | 0.465 | 0.195 | 1.240 | 0.111 | 4400 |
| 2 | NaOH + $NaHCO_3$ + 30 g/l $H_2O_2$ (Preferred Sol.) | Buffered Alkaline Spray | 0.645 | 0.340 | 1.401 | 0.106 | 5600 |
| 3 | $ZnSO_4 7H_2O$ + 18 g/l $H_2O_2$ | Acidic Immersion with Electrochemical Assist 10 A/dm$^2$ | 5.42 | 2.56 | 1.490 | 0.200 | 1600 |
| 4 | $ZnSO_4 7H_2O$ + 50 g/l $NaNO_3$ | Acidic Immersion with Electrochemical Assist 10 A/dm$^2$ | 1.14 | 0.58 | 1.395 | 0.119 | — |
| 5 | $ZnSO_4 7H_2O$ + 10 g/l $NaNO_3$ + 10 g/l $ZnNO_3 + 6H_2O$ | Immersion with Anodic Electrochemical Assist 10 A/dm$^2$ | 5.38 | 2.65 | 1.518 | 0.095 | 3200 |
| 6 | Untreated Electrogalvanized | — | 0.154 | 0.081 | 1.215 | 0.120 | 4400 |

wiping means 24 to remove excess coating from the surface of the steel sheet. At this point the sheet steel strip may either be annealed in ovens to produce an annealed product commonly known as galvanneal, or by-pass the annealing step to be sold as a hot-dip galvanized product. In either case, the hot-dip products have an electrolyte solution 25 applied to their coated surfaces in a step similar to the process shown in FIG. 4.

Referring to FIG. 5, the hot-dipped coated product is shown being immersed into tank 26 containing an electrolyte solution 25, comprising zinc ions. This step is done prior to the application of the alkaline solution treatment to form a zinc oxide layer on the surface of the hot-dip coating. As heretofore described, the electrolyte may be applied to the hot-dipped coated surface of the sheet steel strip by any suitable means known in the art such as spraying or roll coating. However, it should again be understood that the step applying the electrolyte solution 25 is not an electrochemical assisted process.

Following the application of the electrolyte solution, the strip is advanced to an alkaline solution treatment station 5 similar to the treatment stations shown in FIGS. 1 and 2. Treatment station 5, shown in plating line "C", comprises a spray means 27 to apply the alkaline solution containing an oxidizer to the surface of the hot-dipped coated sheet steel strip.

After the alkaline solution has caused a zinc oxide layer to form on the surface of the strip, the strip is advanced to wash station 28 where a water rinse is applied to the coated sheet product. The strip is then advanced to a drying station 29 where an air, or resistance, or other suitable means dryer is used to dry the rinsed sheet product, after which the sheet continues to move toward further processing such as oiling, shearing to length and wrapping or coiling for shipping.

In any of the embodiments shown in FIGS. 1–5, either a buffered or non-buffered alkaline solution comprising an oxidizer may be used to form an oxide layer on at least one surface of a plated or coated sheet steel product.

While this invention has been described as having a preferred design, it is understood that it is capable of further modifications, uses and/or adaptations of the invention, following the general principle of the invention and including such departures from the present disclosure as have come within known or customary practice in the art to which the invention pertains, and as may be applied to the central features hereinbefore set forth, and fall within the scope of the invention of the limits of the appended claims.

We claim:

1. An electrogalvanized sheet or strip having improved formability and weldability, the sheet or strip produced by the steps of:

a. providing an electrogalvanized sheet or strip;

b. chemically applying to the electrogalvanized sheet or strip a buffered alkaline solution having a pH of from about 7.8 to 8.4; and c. applying the buffered alkaline solution for a period sufficient to form a zinc oxide layer on the electrogalvanized sheet or strip layer having a $Zn^{++}$ concentration of at least 0.340 g/m$^2$, said sheet or strip with the forced zinc oxide layer having improved formability as measured by a limited dome height of at least 1.401 inches and a coefficiction of at least 0.106, and having improved weldability as measured by a tip life of at least 4400 welds.

2. The sheet or strip of claim 1, wherein:

a) said zinc oxide layer has a coating weight in excess of 0.15 g/m$^2$.

3. A zinc coated sheet or strip having improved formability and weldability, the sheet or strip produced by the steps of:

a) providing a zinc coated sheet or strip;

b) chemically applying to the zinc coated sheet or strip a buffered alkaline solution having a pH of from about 7.8 to about 8.4; and c) applying the solution for a period sufficient to form a zinc oxide layer on the zinc coated sheet of strip said layer having a $Zn^{++}$ concentration of at least 0.340 g/m$^2$, said sheet or strip with the formed zinc oxide layer having improved formability as measured by a limited dome height of at least 1.401 inches and a coefficient of friction of at least 0.106, and having improved weldability as measured by a tip life of at least 4400 welds.

4. The sheet or strip of claim 3, wherein:

a) said zinc oxide layer has a coating weight in excess of 0.15 g/m$^2$.

5. A zinc coated sheet or strip having improved form ability and weldability, comprising:

a zinc oxide layer formed on at least one surface of a zinc coated sheet or strip, said layer having a $Zn^{++}$ concentration of at least 0.340 g/m$^2$, the sheet or strip with the forced zinc oxide layer having improved formability as measured by a limited dome height of at least 1.401 inches, and a coefficient of friction of at least 0.106, and having improved weldability as measured by a tip life of at least 4400 welds.

6. The sheet or strip of claim 5, wherein said zinc oxide layer having a coating weight in excess of 0.15 g/m$^2$.

7. The sheet or strip of claim 5, wherein:

a) the sheet or strip is electrogalvanized.

* * * * *

UNITED STATES PATENT AND TRADEMARK OFFICE

CERTIFICATE OF CORRECTION

PATENT NO. : 5,714,049

DATED : February 3, 1998

INVENTOR(S) : C. Ramadeva Shastry, et al.

It is certified that error appears in the above-indentified patent and that said Letters Patent is hereby corrected as shown below:

Claim 1; line 11:

"...said sheet or strip with the forced" should be corrected to read "...said sheet or strip with the formed"

Claim 1; line 14

"and a coefficient of friction of at least..." should read -- and a coeffictio of at least.. --

Claim 5; line 6:

"forced zinc oxide layer..." should be corrected to read "formed zinc oxide layer..."

Signed and Sealed this

Twenty-ninth Day of September, 1998

*Attest:*

*Attesting Officer*

Bruce Lehman

BRUCE LEHMAN

*Commissioner of Patents and Trademarks*